US008572924B2

(12) United States Patent
Kempf

(10) Patent No.: US 8,572,924 B2
(45) Date of Patent: Nov. 5, 2013

(54) TRUSS HUB AND PARTS WITH VARIABLE CONFIGURATIONS

(75) Inventor: James Kempf, Wallkill, NY (US)

(73) Assignee: Production Resource Group, LLC, New Windsor, NY (US)

( * ) Notice: Subject to any disclaimer, the term of this patent is extended or adjusted under 35 U.S.C. 154(b) by 40 days.

(21) Appl. No.: 13/192,311

(22) Filed: Jul. 27, 2011

(65) Prior Publication Data

US 2012/0023861 A1 Feb. 2, 2012

Related U.S. Application Data

(60) Provisional application No. 61/369,393, filed on Jul. 30, 2010.

(51) Int. Cl.
*E04C 3/02* (2006.01)

(52) U.S. Cl.
USPC ..... 52/655.1; 52/638

(58) Field of Classification Search
USPC ..... 52/36.6, 655.1, 690, 648.1, 238.1, 645, 52/646, 834–836, 40, 637–638, 653.1, 52/656.9, 650.3, 651.1; 248/312; 403/169–178, 217, 218, 248, 252–253, 403/255, 363; 182/150
See application file for complete search history.

(56) References Cited

U.S. PATENT DOCUMENTS

| | | | | |
|---|---|---|---|---|
| 4,021,973 | A * | 5/1977 | Hegg et al. | 52/36.6 |
| 4,493,172 | A * | 1/1985 | Jones | 52/282.2 |
| 4,805,365 | A * | 2/1989 | Bastian | 52/282.2 |
| 4,951,440 | A * | 8/1990 | Staeger | 52/646 |
| 5,315,805 | A * | 5/1994 | Harsch | 52/775 |
| 5,356,234 | A * | 10/1994 | Vangool | 403/170 |
| 5,791,806 | A * | 8/1998 | Giehl | 403/117 |
| 5,802,798 | A * | 9/1998 | Martens | 52/653.1 |
| 5,964,546 | A * | 10/1999 | Castano | 403/344 |
| 6,223,482 | B1 * | 5/2001 | Zohar | 52/109 |
| 6,397,537 | B2 * | 6/2002 | Auer et al. | 52/282.2 |
| 6,550,731 | B1 * | 4/2003 | Kim | 248/223.41 |
| 6,553,738 | B1 * | 4/2003 | Rixen et al. | 52/843 |
| 7,178,765 | B2 * | 2/2007 | Huang | 248/122.1 |
| 7,464,512 | B1 * | 12/2008 | Perina | 52/651.01 |
| 7,779,599 | B2 * | 8/2010 | Jolicoeur et al. | 52/650.3 |
| 2006/0272244 | A1 * | 12/2006 | Jensen | 52/223.5 |
| 2006/0278777 | A1 * | 12/2006 | Atkinson et al. | 248/188.4 |
| 2007/0151193 | A1 * | 7/2007 | Stonecypher | 52/638 |
| 2008/0209842 | A1 * | 9/2008 | Montaner Fraguet et al. | 52/651.07 |

FOREIGN PATENT DOCUMENTS

| | | | |
|---|---|---|---|
| JP | 09111867 A | * | 4/1997 |
| JP | 09111881 A | * | 4/1997 |

* cited by examiner

*Primary Examiner* — Brian Glessner
*Assistant Examiner* — Beth Stephan
(74) *Attorney, Agent, or Firm* — Law Office of Scott C. Harris, Inc.

(57) ABSTRACT

A truss hub with a circular outer shape, that connects to trusses that extend radially away from the truss hub in different directions.

14 Claims, 11 Drawing Sheets

TRUSS HUB AND PARTS WITH VARIABLE CONFIGURATIONS

This application claims priority from 61/369,393, filed Jul. 30, 2010, the entire contents of which are herewith Incorporated by reference.

BACKGROUND

Trusses are often used in stage lighting applications to hold stage lights and other supported equipment, such as winches. The trusses are arranged to be located wherever there is a need for a support.

SUMMARY

The inventor recognizes that trusses may be located in various configurations.

An embodiment describes a truss hub that allows configuring trusses to different configurations. An embodiment describes a universal truss hub.

DETAILED DESCRIPTION

A truss connector or "hub" that Trusses can be attached to different parts of a hub. The truss is attached to the hubs to form different configurations.

Figure 1:
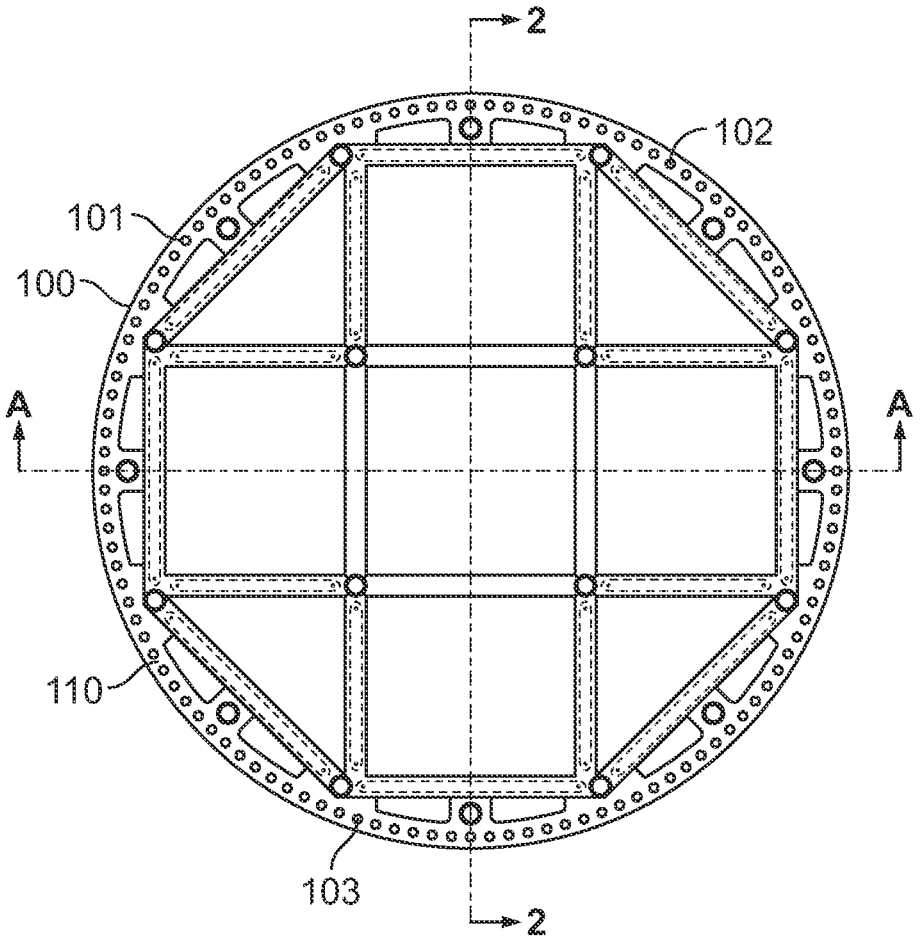
FIG. 1 shows an assembled truss hub from the top.

In a first embodiment is illustrated in FIG. 1. The hub itself 100 includes numerous different connection points such as 101, 102, 103 around the outer periphery of the hub. In actuality, there are many such connection points and any two or three of these connection points can be connected to a truss piece. The hub is round in circular outer diameter, and formed of four separate pieces. Each of the pieces such as 110 is a section of a circle, which includes 30 different connection points thereon. The truss part can be connected to any of these connection points as explained herein. Four of the pieces 110 are connected together to form the truss hub.

Once formed, the truss hub can hold pieces of truss connected to any of the different parts in any of a number of different configurations.

Figure 2:
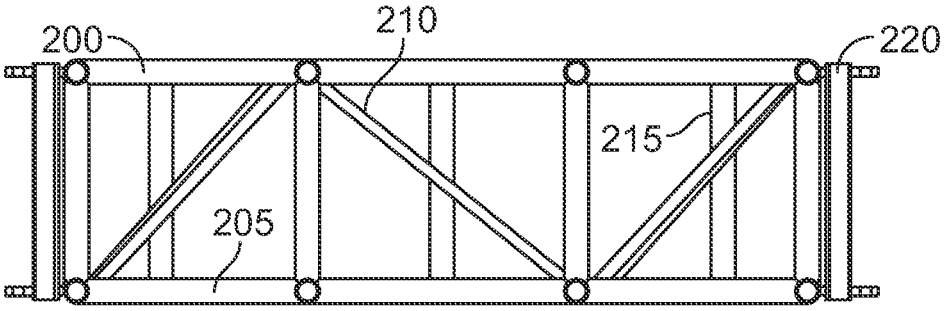
FIG. 2 shows a cross section across line 2-2 in FIG. 1.

The truss hub itself is a structural element, and FIG. 2 shows a cross-section of along the line 2-2 in FIG. 1. The hub piece includes structural tubular bars 200,205 as well as cross pieces 210 to improve the structural support. Other supports, such as the vertical piece 215 may also improve the structural support.

Figure 3:
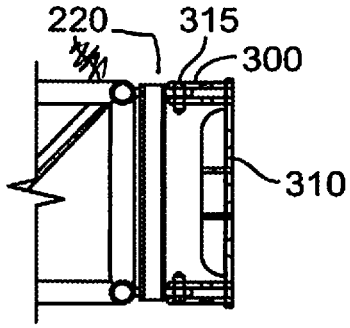
FIG. 3 shows the spigot pins details on the ends of the truss hub.
Figure 4:
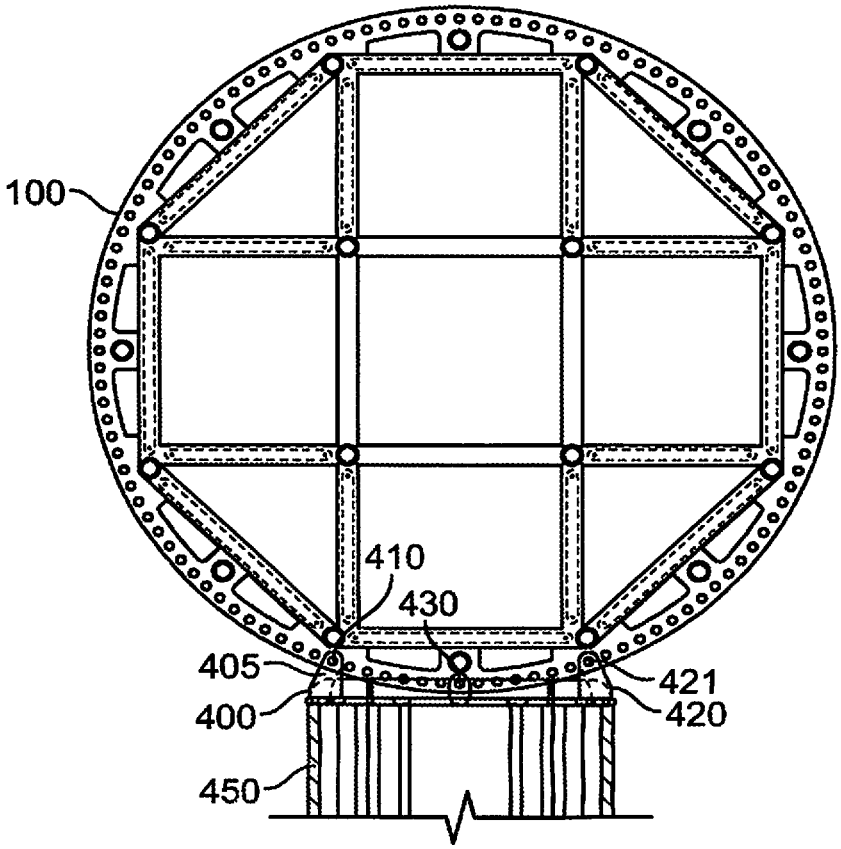
FIG. 4 shows the truss hub with a single truss attached thereto.

The holes such as 102 define areas for connection of connection parts 220 which are adapted, in operation, to connect to a piece of truss. FIG. 3 illustrates how the connection part 220 connects to the standard spigot pins 300 at the end of a piece of truss 310. Hairpin keepers 315 may hold the attachment into place of at the top and the bottom. The universal truss hub thus allows, for one single device, trusses to connect to the universal truss hub in a number of different ways and orientations. Note that even though the outer periphery of the truss hub is generally circular, the truss mount portions 400 can connect across any arcuate section of the truss. Each of the truss pieces connects to the truss hub, radially, with the longitudinal axis of the truss extending radially outward from the central outer section of the truss. FIG. 4 illustrates a configuration in which the universal truss mount 100 is connected to a single truss mount portion 400. Note that one side of the truss mount portion 405 is connected to one of the mounting holes 410 in the universal truss mount. Another side 420 is connected to the truss mount hole 421. According to an embodiment, the truss connection may also include a center mounting portion 430 connected into one of the holes. As in the above, the truss mount portion can connect to a piece of truss generally shown as 450, with the truss piece extending radially away from the hub.

While FIG. 4 shows a configuration with only one radial truss connected to the universal mount, it should be understood that other configurations of the same truss mount device allow different numbers of trusses to be connected thereto.

Figure 5:
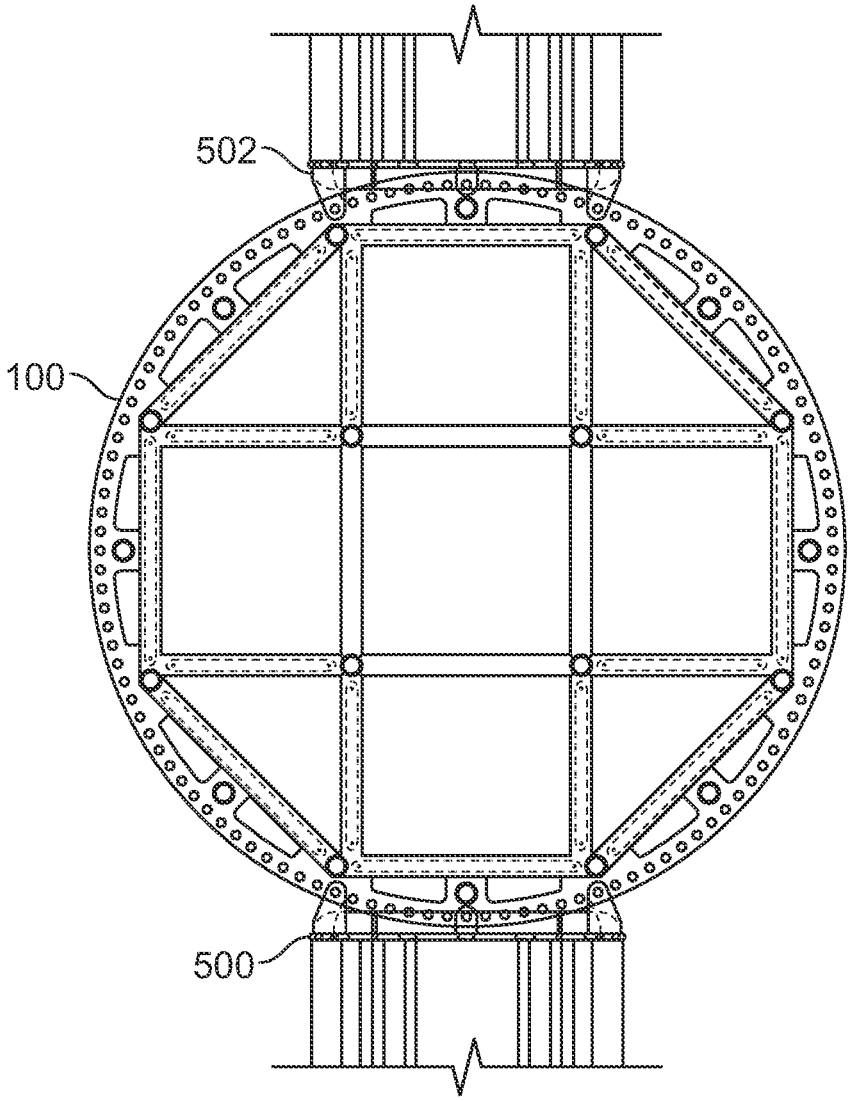
FIGS. 5-11 show alternate configurations in which respectively 2-8 trusses are attached to different parts of the truss hub in radially extending directions.
Figure 6:
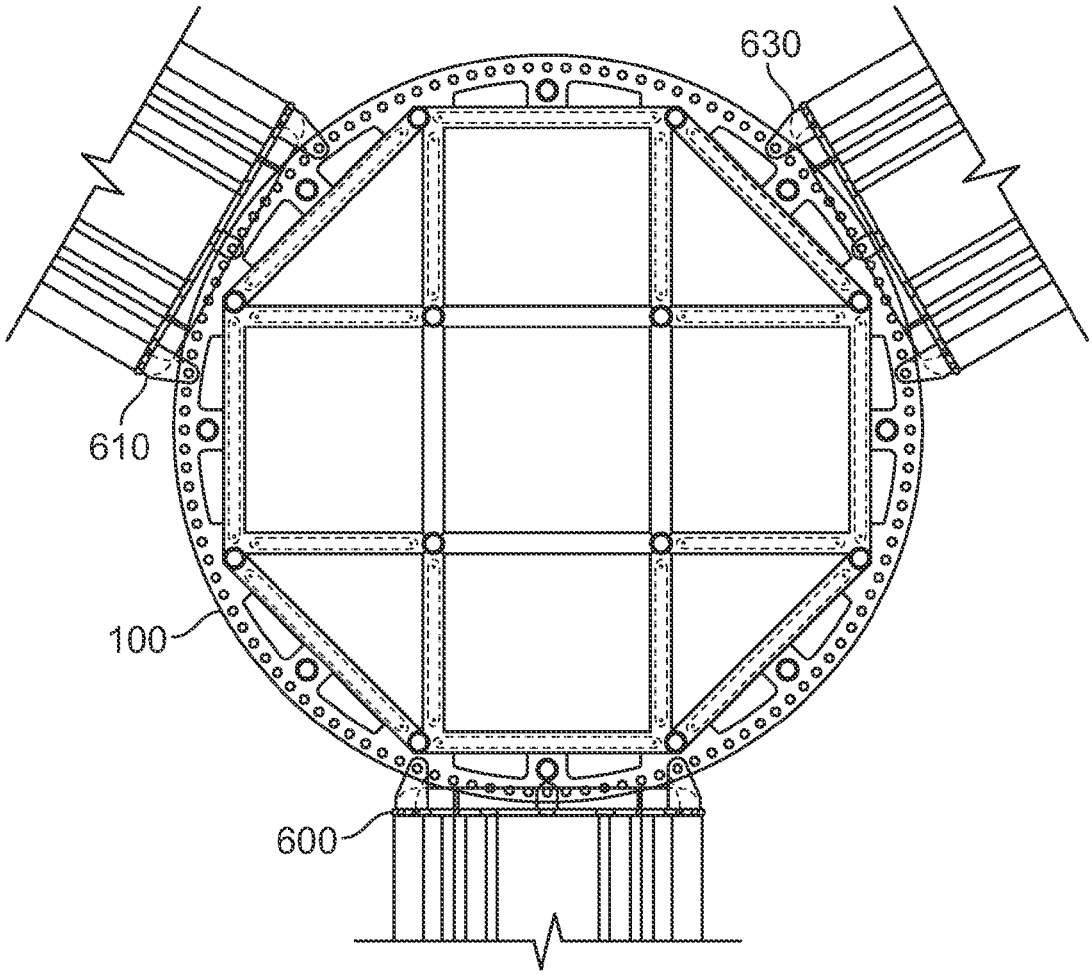
Figure 7:
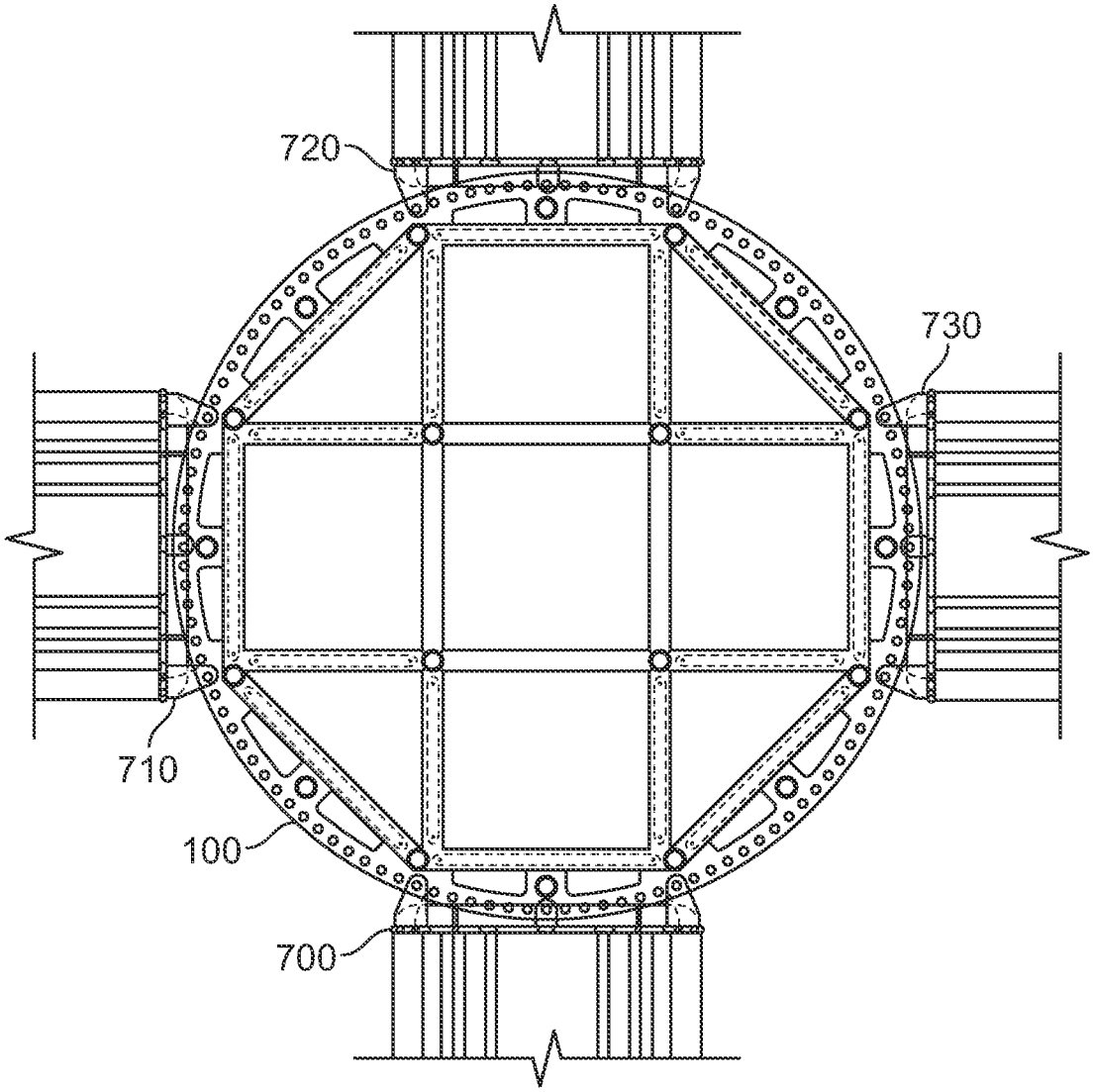
Figure 8:
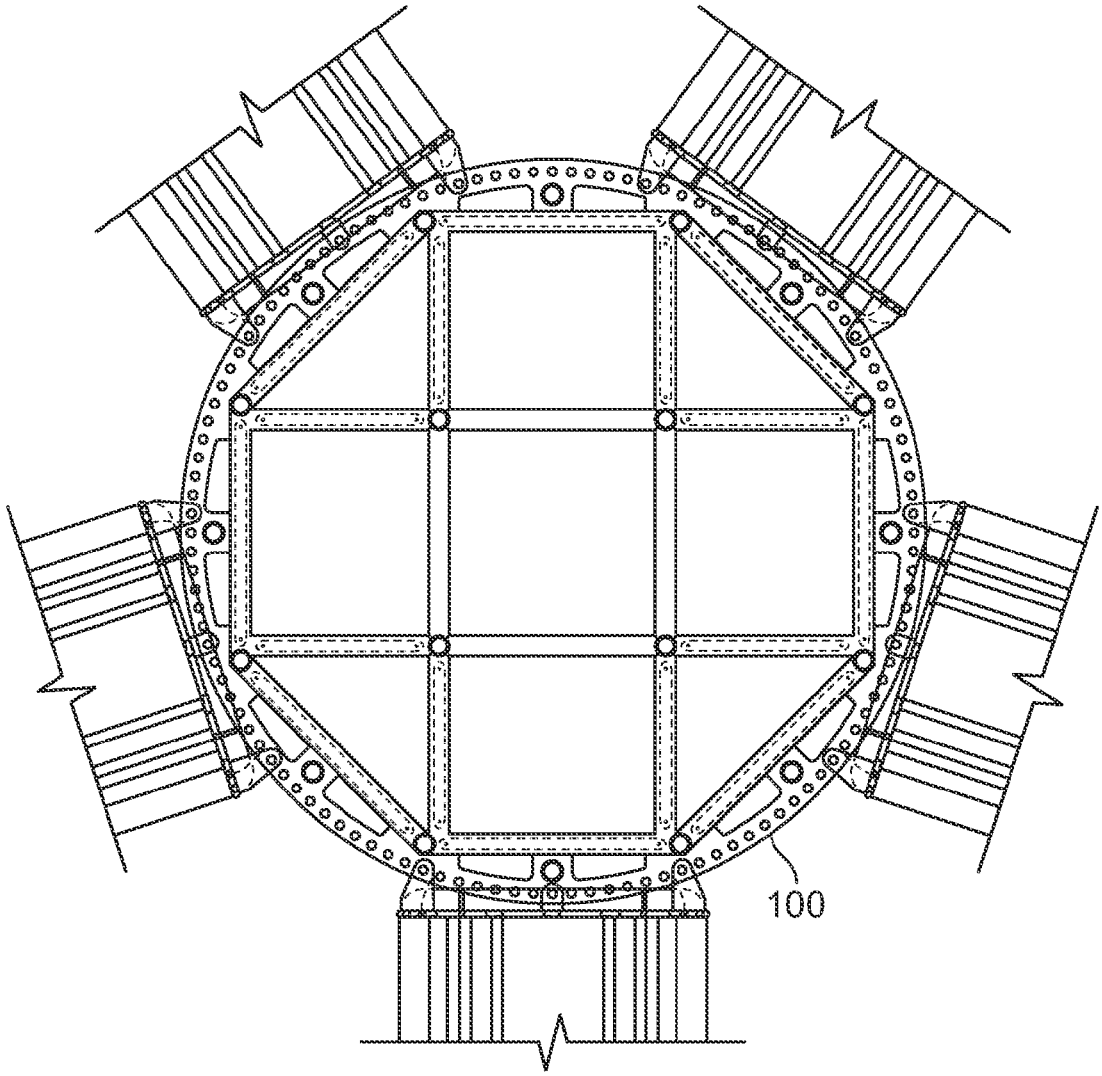
Figure 9:
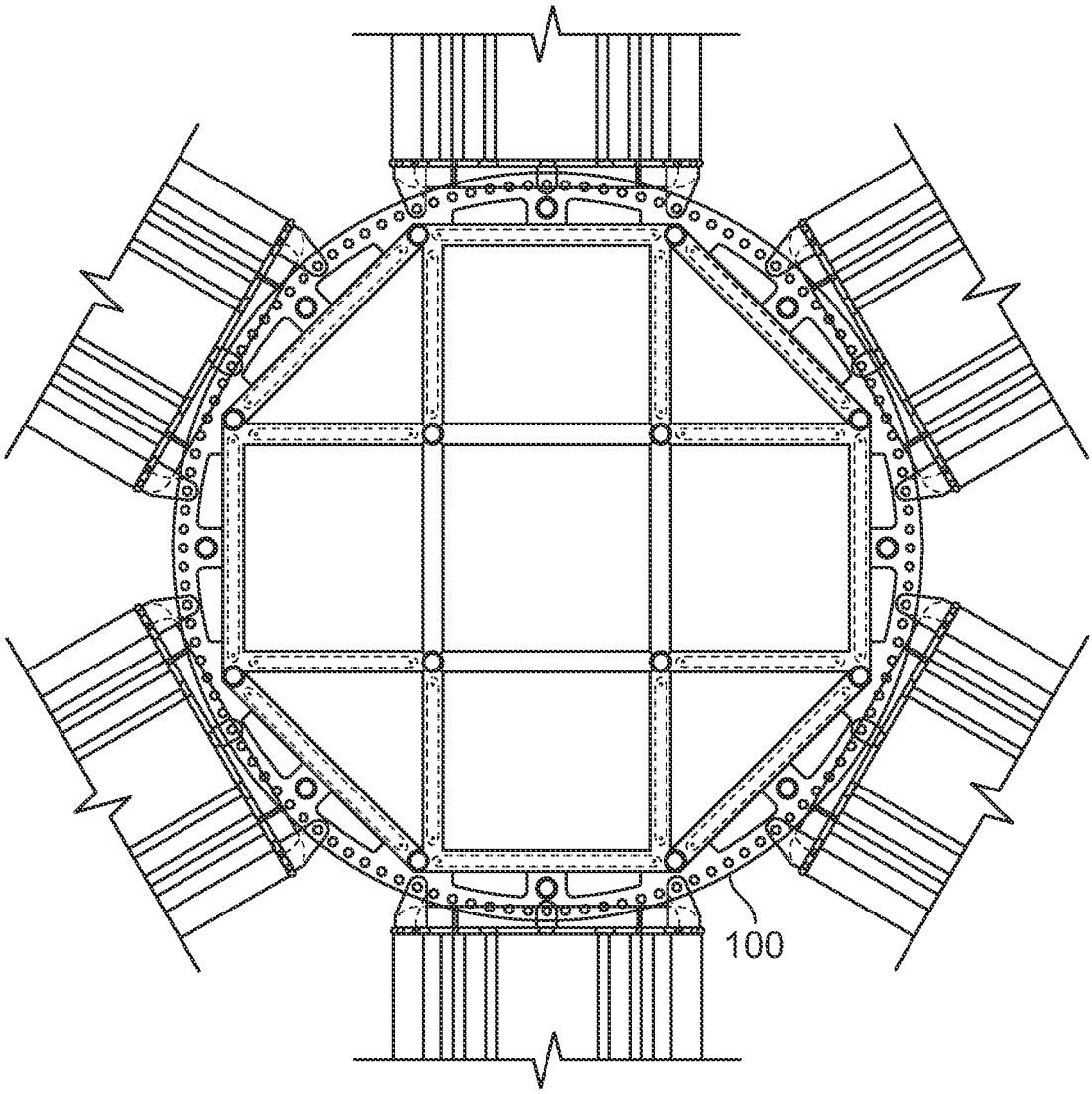
Figure 10:
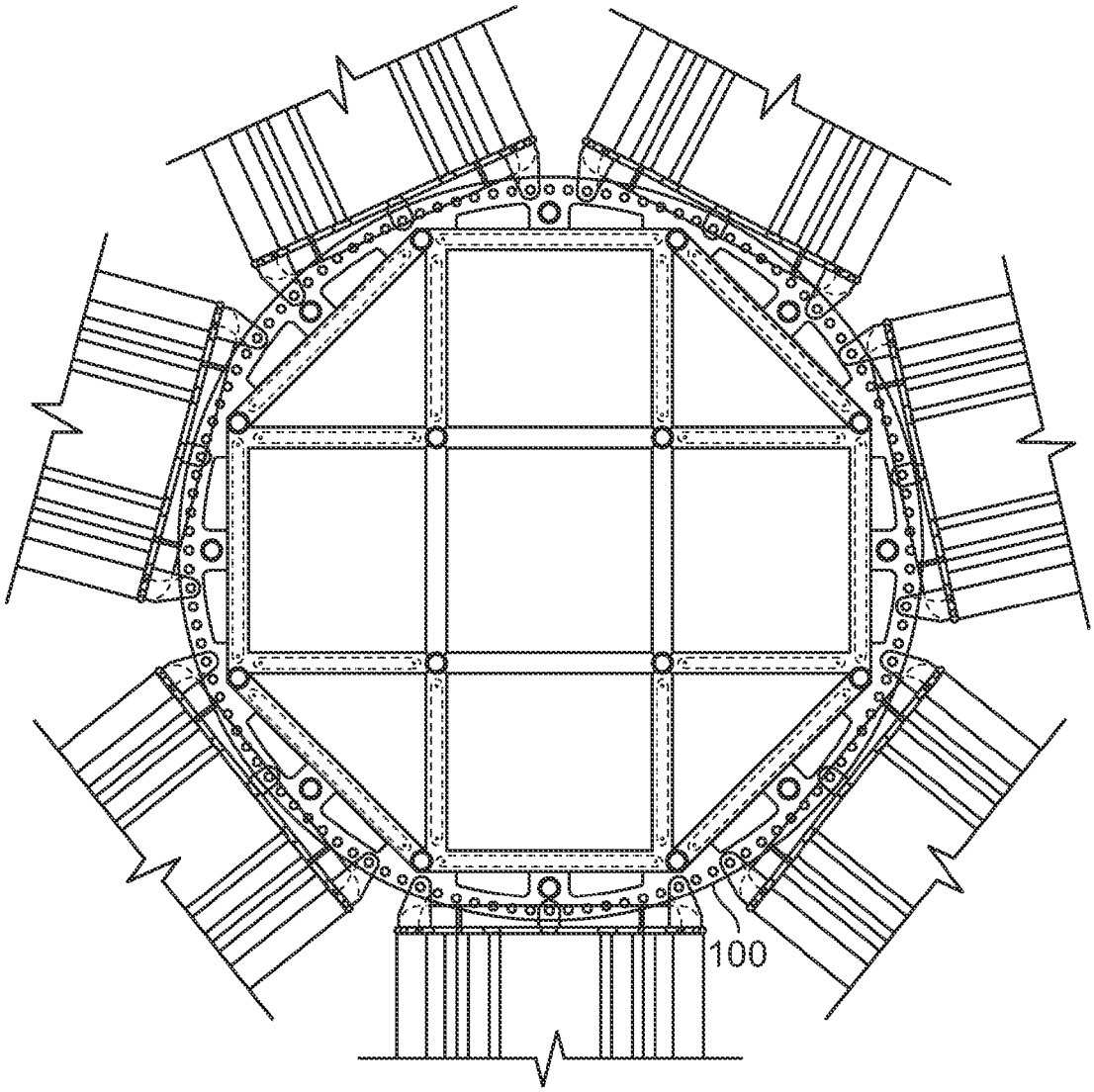
Figure 11:
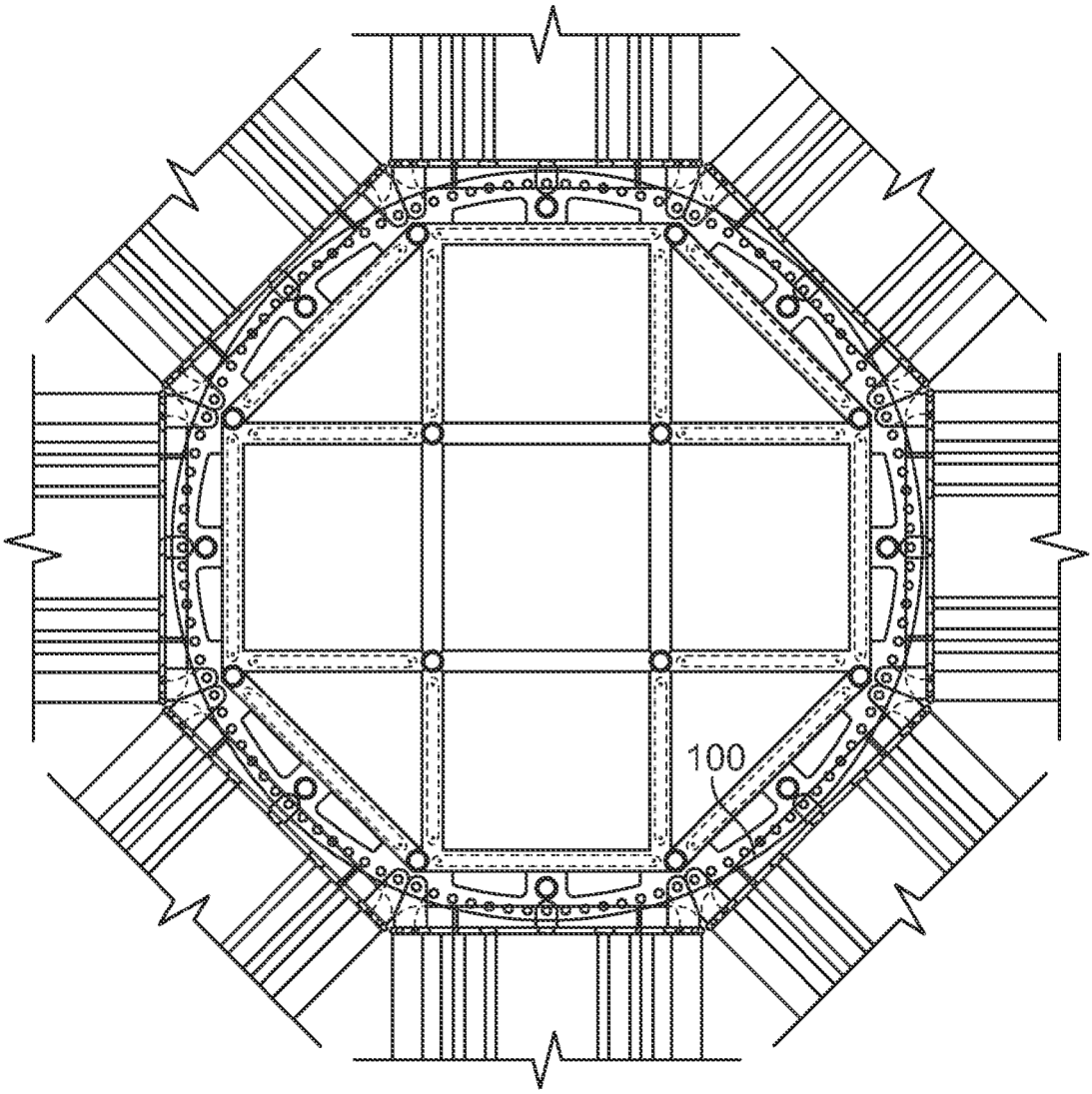
Figure 12:
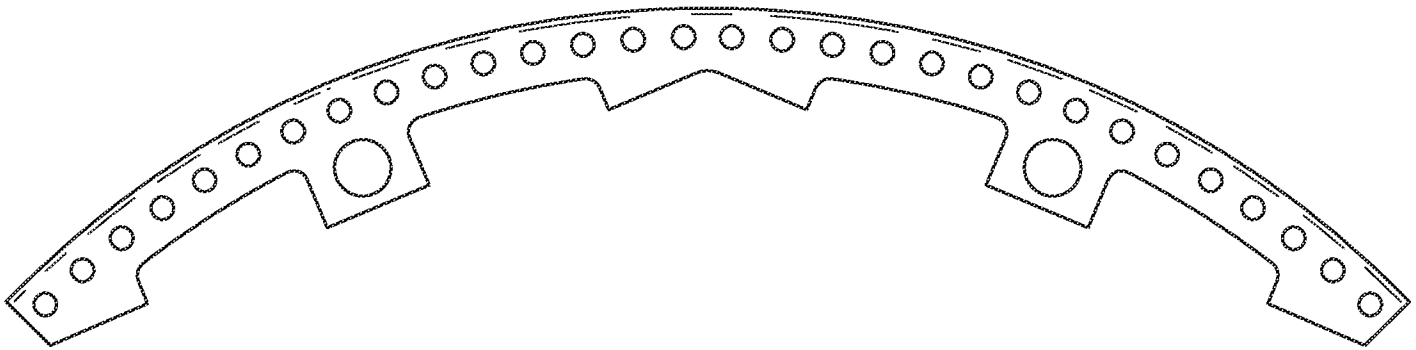
FIG. 12 shows a single piece of the multipiece truss hub.
Figure 13:
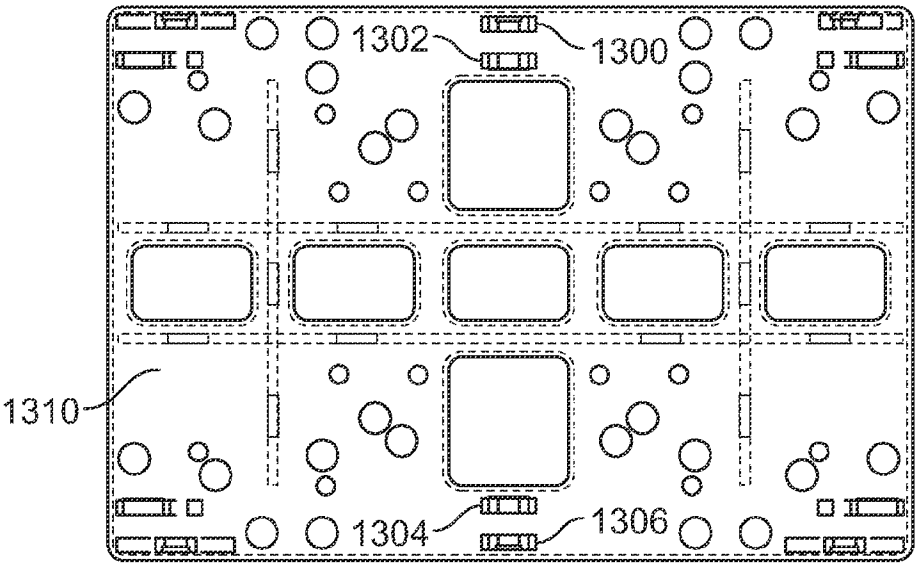

FIG. 5 illustrates the truss mount with two radial truss connectors 500, 502 connected to the truss hub 100. FIG. 6 illustrates the same truss hub 100 connected to three different trusses 600, 610 and 630. In a similar way, FIG. 7 illustrates how the truss hub 100 and be connected to four different truss portions, 700, 710, 720 and 730. FIG. 8 illustrates the central truss hub connected to five different trusses. FIG. 9 illustrates the truss 100 connected to six different trusses. FIG. 10 illustrates the truss of connected to seven different trusses. FIG. 11 illustrates the truss hub connected to eight different trusses. Any of one through eight trusses can be connected using the same truss hub in different configurations. FIG. 12 shows a close-up of one section of the truss hub, showing the hub flange which is machined from three-quarter inch aluminum with a number of the holes therein as previously described. Four of these sections are bolted together to form the outer periphery of the truss hub. FIG. 13 shows a close-up view of the hub attachment portions 1310 as shown in FIG. 1. This attachment portion can be connected to any portion on the outer diameter of the truss hub, and thereby connect between 1 and 8 different pieces of truss.

Figure 14:
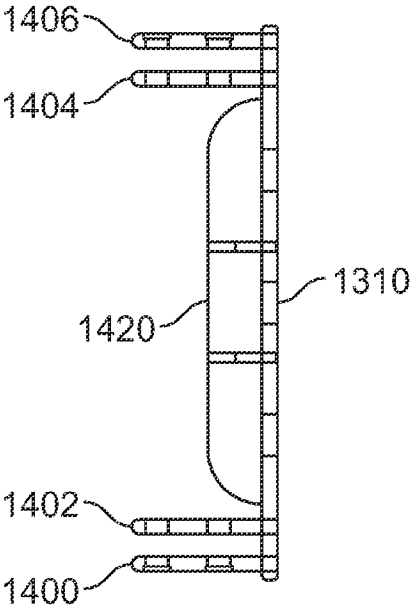
FIGS. 13-15 show the different parts making up the truss hub.
Figure 15:
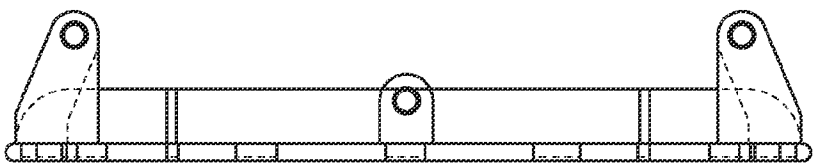

FIG. 13 illustrates a front view of this device, showing the different counterbores facing outward 1300, 1302, 1304, 1306. This may form the location for the center connection portion of the truss of connecting to the center of the diameter area, as needed. A side view shown in FIG. 14 shows the front surface of the hub, and also shows the different attachment pieces 1400, 1402, 1404, 1406 that can be used to connect to the actual hub parts. A plan view shown in FIG. 15 illustrates how these connection pieces can connect to the truss hub, and also provide a connection interface for connecting to the actual truss pieces themselves. A stiffener 1420 may be a vertical piece of ⅜ inch aluminum which may be located along the plate in order to stiffen the connection.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art. For example, other kinds and sizes of truss can be used.

Also, the inventor intends that only those claims which use the words "means for" are intended to be interpreted under 35 USC 112, sixth paragraph. Moreover, no limitations from the specification are intended to be read into any claims, unless those limitations are expressly included in the claims.

Where a specific numerical value is mentioned herein, it should be considered that the value may be increased or decreased by 20%, while still staying within the teachings of the present application, unless some different range is specifically mentioned.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A truss hub device, comprising:

a first interface portion, having a circular outer shape, a second interface portion spaced from the first interface portion, having a circular outer shape, a plurality of different connection parts along said circular outer shape, the connection parts connected to and between the first and the second interface portions, wherein each of said connection parts being along said circular outer shape, each of said connecting parts having upper and lower attachment pins, a first attachment piece connected to at least first and second of said different connection parts on said hub, said first attachment piece having first and second truss connection interfaces which are sized and shaped to attach to a first structural truss, and said first attachment piece having a first plate, connected between and attached to said first and second connecting parts, said first plate having a flat surface extending between said first and second connecting parts, the flat surface having spigot pins extending therefrom attached to the attachment pins of the connection parts, and a stiffener plate, having a surface oriented perpendicular to the flat surface of the first plate, and extending at least partway between said first and second connecting parts and stiffening a connection between said first and second connecting parts;

a second attachment piece having spigot pins, the second attachment piece connected to at least third and fourth of said different connection parts on said hub, the spigot pins of second attachment piece connected to the attachment pins of the connection parts, said second attachment piece having first and second truss connection interfaces which are sized and shaped to attach to a second structural truss and said second attachment piece having a second plate, connected between and attached to said third and fourth connecting parts, the second plate having spigot pins extending therefrom attached to the attachment pins of the connection parts, and a second stiffener plate, oriented perpendicular to the second plate, and extending at least partway between said third and fourth connecting parts and stiffening a connection between said third and fourth connecting parts, and wherein an angle is defined between said first and second structural trusses based on which of said connection parts connected said connection pieces.

2. A device as in claim 1, wherein said interface portions each have enough holes to hold at least 8 different pieces truss to said interface portions portion.

3. A device as in claim 1, wherein said interface portions are each formed in multiple separate sections that are connected together.

4. A device as in claim 3, wherein each of said sections define substantially a quarter of a circumference of said circular outer shape.

5. A device as in claim 1, further comprising said first and second structural trusses, each of said first and second structural trusses having at least first and second tubular supports, with structural connections between said first and second tubular supports.

6. A device as in claim 5, wherein each of said trusses is connected to said periphery on the device at first, second and third separate locations.

7. A truss hub device, comprising:

a first interface portion, a second interface portion, having a circular outer shape, a plurality of different connection parts along a circular outer shape and connected to and between the first and the second interface portions, wherein each of said connection parts being along said circular outer shape, said connecting parts having upper and lower attachment pins, a first attachment piece connected to at least first and second of said different connection parts on said hub, said first attachment piece having first and second truss connection interfaces which are sized and shaped to attach to a first structural truss, and said first attachment piece having a first plate, connected between and attached to said first and second connecting parts, said first plate having a flat surface extending between said first and second connecting parts, the flat surface having spigot pins extending therefrom attached to the attachment pins of the connection parts, and a stiffener plate, having a surface oriented perpendicular to the flat surface of the first plate, and extending at least partway between said first and second connecting parts and stiffening a connection between said first and second connecting parts;

a second attachment piece, connected to at least third and fourth of said different connection parts on said hub, said second attachment piece having first and second truss connection interfaces which are sized and shaped to attach to a second structural truss, and said second attachment piece having a second plate, connected between and attached to said third and fourth connecting parts, the second plate having spigot pins extending therefrom attached to the attachment pins of the connection parts, and a second stiffener plate, oriented perpendicular to the second plate, and extending at least partway between said third and fourth connecting parts and stiffening a connection between said third and fourth connecting parts, said first and second attachment pieces connected to said trusses to form a specified angle between said trusses.

8. A device as in claim 7, wherein said interface portions each having a circular outer shape.

9. A device as in claim 8, where each of said connection parts being along said circular outer shape, and allowing connecting a straight portion to said circular outer shape, and wherein each of said connection parts allows connecting said straight portion to face at a different angle relative to said truss hub device.

10. A device as in claim 7, wherein said interface portions allow connecting additional different truss pieces to said interface portions.

11. A device as in claim 8, wherein said interface portions are each formed in multiple separable but connected sections.

12. A device as in claim 11, wherein each of said sections define substantially a quarter of a circumference of said circular outer shape.

13. A device as in claim 7, further comprising said first and second structural trusses, each of said first and second structural trusses having at least first and second tubular supports, with structural connections between said first and second tubular support.

14. A device as in claim 13, wherein each of said trusses is connected to said periphery on the device at first, second and third separate locations.

* * * * *